US007932916B2

(12) United States Patent
Kim et al.

(10) Patent No.: US 7,932,916 B2
(45) Date of Patent: Apr. 26, 2011

(54) ORGANIC LIGHT EMITTING DIODE DEVICE CAPABLE OF DECREASING DATA PROCESING CAPACITY AND TIMING CONTROLLER SUITABLE FOR THE SAME

(75) Inventors: Seong Gyun Kim, Seoul (KR); Seok Hee Jeong, Taegu-kwangyokshi (KR)

(73) Assignee: LG Display Co., Ltd., Seoul (KR)

( * ) Notice: Subject to any disclaimer, the term of this patent is extended or adjusted under 35 U.S.C. 154(b) by 896 days.

(21) Appl. No.: 11/119,708

(22) Filed: May 3, 2005

(65) Prior Publication Data

US 2006/0033445 A1 Feb. 16, 2006

(30) Foreign Application Priority Data

Aug. 10, 2004 (KR) ..... 10-2004-0062814

(51) Int. Cl.
*G09G 5/10* (2006.01)

(52) U.S. Cl. ..... 345/690; 345/83

(58) Field of Classification Search ..... 345/690, 345/691, 82, 83, 76, 77, 78, 601; 348/800, 348/801, 519; 315/169.3
See application file for complete search history.

(56) References Cited

U.S. PATENT DOCUMENTS

| | | | | |
|---|---|---|---|---|
| 2,884,484 | A * | 4/1959 | Deichert | 348/675 |
| 6,084,561 | A * | 7/2000 | Kudo et al. | 345/89 |
| 2002/0030652 | A1 * | 3/2002 | Shibata et al. | 345/87 |
| 2003/0001810 | A1 * | 1/2003 | Yamaguchi et al. | 345/87 |
| 2003/0016199 | A1 * | 1/2003 | Lee et al. | 345/88 |
| 2004/0066363 | A1 * | 4/2004 | Yamano et al. | 345/98 |
| 2004/0080521 | A1 * | 4/2004 | Nose et al. | 345/690 |
| 2004/0150602 | A1 * | 8/2004 | Furukawa et al. | 345/98 |
| 2005/0030214 | A1 * | 2/2005 | Jo | 341/145 |
| 2005/0190610 | A1 * | 9/2005 | Furukawa et al. | 365/189.05 |
| 2005/0225562 | A1 * | 10/2005 | Higgins et al. | 345/604 |
| 2005/0276502 | A1 * | 12/2005 | Brown Elliott et al. | 382/254 |

FOREIGN PATENT DOCUMENTS

| | | | |
|---|---|---|---|
| JP | 1-115444 | A | 5/1989 |
| JP | 2003-29724 | A | 1/2003 |
| JP | 2003-108072 | A | 4/2003 |
| JP | 2003-330420 | A | 11/2003 |
| KR | 1020030005748 | A | 1/2003 |
| KR | 10-2004-0041939 | A | 5/2004 |

OTHER PUBLICATIONS

Korean Office Action dated Jan. 13, 2011 for corresponding Korean Application No. KR 10-2004-0062814.

* cited by examiner

*Primary Examiner* — Chanh Nguyen
*Assistant Examiner* — Robert M Stone
(74) *Attorney, Agent, or Firm* — Birch, Stewart, Kolasch & Birch, LLP

(57) ABSTRACT

An organic light emitting diode (OLED) device and a method of driving the OLED device are provided. The OLED device according to an embodiment includes a timing controller and a data drive unit. The timing controller performs a gamma correction of inputted image data for the OLED device, and then changes a bit number of the gamma-corrected image data to thereby output converted image data. The data drive unit outputs a data drive signal on the basis of the converted image data.

4 Claims, 8 Drawing Sheets

ORGANIC LIGHT EMITTING DIODE DEVICE CAPABLE OF DECREASING DATA PROCESING CAPACITY AND TIMING CONTROLLER SUITABLE FOR THE SAME

This application claims the priority benefit of the Korean Patent Application No. 10-2004-62814 filed on Aug. 10, 2004, which is hereby incorporated by reference.

BACKGROUND OF THE INVENTION

1. Field of the Invention

The present invention relates to an organic light emitting diode (OLED) device, and more particularly, to a driving circuit of an OLED device and a method for driving the same, in which image data is processed by Frame Rate Control (FRC) and dithering, so that it is possible to decrease data processing capacity, area of drive IC, and power consumption.

2. Discussion of the Related Art

In general, a cathode ray tube (CRT), which is one type of flat display devices, has been widely used for monitors of a television, a measuring apparatus, and an information terminal. However, the CRT cannot satisfy the demands for compact size and lightweight due to the size and weight of the CRT itself. Thus, various display devices, for example, a liquid crystal display (LCD) device using electric field optical effect, a plasma display panel (PDP) using a gas discharge, a field emission display device, and an electroluminescence display (ELD) device using an electric field luminous effect, have been studied to substitute the CRT.

Among the various display devices, the ELD device is a display device of using electroluminescence (EL) phenomenon, wherein the EL phenomenon indicates the state of generating light when an electric field above a predetermined level is applied to a fluorescent substance. The ELD device is classified into an inorganic electroluminescence display device and an organic electroluminescence display (OELD) device.

The OELD device has attracted great attention as a high-picture quality device since the OELD device displays all colors of visible rays. Also, the OELD device realizes high luminance using a low driving voltage. In addition, the OELD device emits light in itself, whereby the OELD device has great contrast ratio, and the OELD device is suitable for realizing an ultra-thin display device. Also, since the OELD device has a simplified fabrication process, it may generate less environmental pollution. In the meantime, the OELD device has a rapid response time of several microseconds, whereby the OELD device is useful to obtain moving picture images. Furthermore, the OELD device has no limit to a viewing angle, and the OELD device is stably operated at a low temperature. Also, the OELD device can be operated at a high voltage between 5V and 15V. As a result, the OELD device has the simplified fabrication process and the simple design.

The OELD device is very similar in structure to the inorganic ELD device. However, the OELD device generates light by recombination of electron and hole, whereby the OELD device is referred to as an organic light emitting diode (OLED).

The OELD device emits light in itself, so that the OELD device has wide viewing angle and high contrast, as compared with the LCD device. Also, since the OELD device does not require a separate backlight unit, the OELD device can realize thin profile and low power consumption. In addition, the OELD device is driven at a low D.C. voltage, and the OELD device has a rapid response speed. Also, the OELD device is formed of a solid material. As a result, the OELD device can endure external forces, and the OELD device can be driven in a wide range of temperature. Furthermore, the OELD device has the advantage of low fabrication cost.

Unlike the LCD device or the PDP device, when fabricating the OELD device, it only requires equipment for deposition and encapsulation, thereby realizing the simplified fabrication process.

Especially, if the OELD device is driven in an active matrix method of having a thin film transistor of a switching device in each pixel region, it is possible to realize low power consumption, high resolution, and large size in the OELD device, even though a low current is applied to the OELD device.

In case of the active matrix type, a plurality of pixel regions are formed in the matrix type, and a thin film transistor is connected to each pixel region. This active matrix type is generally used for the flat display device. Hereinafter, an active matrix organic light emitting display (AMOLED) device, in which the active matrix type is applied to the OLED, will be described with reference to the accompanying drawings.

FIG. 1 is a circuit diagram illustrating an OELD device according to the related art. As shown in FIG. 1, the OELD device according to the related art includes a gate line 1, a data line 2, a switching thin film transistor 4, a driving thin film transistor 5, a storage capacitor 6, and a light emitting diode 7. Although a single pixel unit is shown, it is known that the OELD device has a plurality of such pixel units in the matrix form.

At this time, a gate electrode of the switching thin film transistor 4 is connected with the gate line 1, and a source electrode is connected with the data line 2. Also, a drain electrode of the switching thin film transistor 4 is connected with a gate electrode of the driving thin film transistor 5, and a drain electrode of the driving thin film transistor 5 is connected with an anode electrode of the light emitting diode 7. Also, a source electrode of the driving thin film transistor 5 is connected with a power line 3, and a cathode electrode of the light emitting diode 7 is grounded. Next, the storage capacitor 6 is connected with the gate and source electrodes of the driving thin film transistor 5.

Accordingly, if a gate signal is applied through the gate line 1, the switching thin film transistor 4 is turned on. Then, as a data signal of the data line 2 is transmitted to the gate electrode of the driving thin film transistor 5 through the switching thin film transistor 4, the driving thin film transistor 5 is turned on, whereby light is emitted from the light-emitting diode 7. At this time, when the switching thin film transistor 4 is turned off, the storage capacitor 6 stably maintains the gate voltage of the driving thin film transistor 5.

FIG. 2 is a cross sectional view illustrating the driving thin film transistor and the light emitting diode of FIG. 1.

FIG. 2 illustrates the related art OLED device. Referring to FIG. 2, a buffer layer 11 of an insulating material, for example, silicon oxide $SiO_2$ is formed on the entire surface of a substrate 10. Also, island-shaped polysilicon layers 21, 22 and 23 are formed on predetermined portions of the buffer layer 11. At this time, the polysilicon layers 21, 22 and 23 are divided into an active layer 21, and source and drain regions 22 and 23, wherein the active layer 21 of the thin film transistor is not doped with impurity ions, and the source and drain regions 22 and 23 are doped with impurity ions. At this time, the polysilicon layers 21, 22 and 23 are formed in a method of crystallizing an amorphous silicon layer.

Then, a gate insulating layer 30 is formed on the polysilicon layers 21, 22 and 23, wherein the polysilicon layers 21, 22 and 23 are divided into the active layer 21 of the thin film transistor, and the source and drain regions 22 and 23 doped with the impurity ions. The gate insulating layer 30 is formed on the entire surface of the buffer layer 11 including the polysilicon layers 21, 22 and 23. Subsequently, a gate electrode 42 is formed on the gate insulating layer 30 above the active layer 21.

Then, an insulating interlayer 50 is formed on the gate insulating layer 30 including the gate electrode 42, wherein the insulating layer 50 has first and second contact holes 50*a* and 50*b* for exposing predetermined portions of the source and drain regions 22 and 23 of the polysilicon layers. At this time, the insulating interlayer 50 is formed of a dual-layered structure having first and second insulating interlayers 51 and 52.

Next, a source electrode 62 and a drain electrode 63 are formed on predetermined portions of the insulating interlayer 50 and in the first and second contact holes 50*a* and 50*b*, wherein the source and drain electrodes 62 and 63 are formed of a conductive material such as metal. At this time, the source and drain electrodes 62 and 63 are respectively connected with the source and drain regions 22 and 23 of the polysilicon layers through the first and second contact holes 50*a* and 50*b*.

After that, a passivation layer 70 is formed on the entire surface of the insulating interlayer 50 and the source and drain electrodes 62 and 63. At this time, the passivation layer 70 has a third contact hole 71 for exposing the drain electrode 63 in the second contact hole 50*b*.

Then, a pixel electrode 81 is formed on predetermined portions of the passivation layer 70 and in the third contact hole 71, wherein the pixel electrode 81 contacts the drain electrode 63 through the third contact hole 71. At this time, the pixel electrode 81 is formed of a transparent conductive material. Also, the pixel electrode 81 serves as the anode electrode of the light emitting diode.

In the OLED device according to the related art, a drive IC for applying the data signal to the data line has linear output characteristics. Thus, in order to perform gamma correction, inputted data having a predetermined bit number is converted so that the converted data has a larger bit number than the predetermined bit number of the inputted data. As the bit number of data increases, the drive IC increases in size and power consumption.

FIG. 3 is a block diagram illustrating the related art OLED device. FIG. 4 is a graph illustrating the luminance characteristics by gray level before and after the gamma correction of FIG. 3.

As shown in FIG. 3 and FIG. 4, a driving circuit of the related art OLED device includes a gate drive unit 103, a data drive unit 105, and a timing controller 110. At this time, the gate drive unit 103 and the data drive unit 105 respectively apply driving signals to gate and data lines formed on a panel 100. The panel 100 includes a plurality of pixel units of FIGS. 1 and 2 as discussed above. Also, the timing controller 110 controls the gate drive unit 103 and the data drive unit 105.

The timing controller 110 receives RGB image data of n-bit and synchronized signals HSYNC and VSYNC for displaying the corresponding RGB image data from a graphic source (not shown) of a system. Then, the timing controller 110 performs gamma correction and color compensation on the RGB image data, and outputs the compensated RGB data of m-bit to the data drive unit 105.

In the meantime, the timing controller 110 further includes a data convert unit 111 for converting the gamma characteristic of RGB image data to a gamma 2.2 curve.

The data convert unit 111 receives the RGB image data of n-bit, and converts the gamma characteristics of the received original RGB image data to the gamma 2.2 curve shown in FIG. 4. Then, the data convert unit 111 outputs the RGB image data of m-bit having the converted gamma characteristics. At this time, the data convert unit 111 performs the conversion of the gamma characteristics by LUT (Look-Up Table) or arithmetic of a numerical formula. For any pixel, the bit number of the RGB image data having the converted gamma characteristics is always larger by two than the bit number of the original RGB data.

FIG. 4 illustrates the gamma curve of the original RGB image data in comparison with the gamma 2.2 curve showing essential factors of the gamma characteristic in RGB color area. In FIG. 4, the horizontal axis shows the gray level wherein a maximum value of the input RGB image is set to '1', and the vertical axis shows the luminance level wherein a maximum value to the corresponding gray level is set to '1'. To satisfy the essential factors of the RGB color area, it is necessary to convert the gamma characteristics of the RGB data according to the gamma 2.2 curve.

However, the related art OLED device has the following disadvantages.

In case of the related art OLED device, in order to perform the gamma correction, the inputted data having the predetermined bit number is converted so that the converted data has a bit number larger (by two) than the predetermined bit number of the inputted data. In this state, the converted data is transmitted to the drive IC (data drive unit 105). That is, the data inputted to the timing controller has n-bit, and the data transmitted to the drive IC has m-bit, wherein m=n+2.

In this case, when the drive IC processes the data, the bit number of data is increased to m-bit, whereby the size of the drive IC and the power consumption increase.

SUMMARY OF THE INVENTION

Accordingly, the present invention is directed to a driving circuit of an OLED device (or OELD device) and a method for driving the same that substantially obviates one or more problems due to limitations and disadvantages of the related art.

An object of the present invention is to provide a driving circuit of an OLED device (or OELD device) and a method for driving the same, to decrease the power consumption and size of the driving circuit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an organic light emitting diode (OLED) device comprising: a timing controller for performing a gamma correction of inputted image data for the OLED device, and then changing a bit number of the gamma-corrected image data to thereby output converted image data; and a data drive unit for outputting a data drive signal on the basis of the converted image data.

In accordance with another aspect of the present invention, there is provided a timing controller suitable for an organic light emitting diode (OLED) device, the timing controller comprising: a gamma correction unit to receive an n-bit data and convert the n-bit data to an m-bit data by a gamma correction process, where m>n; and a control unit to convert the m-bit data to an n'-bit data by a dithering process, where n'=n or n'=n+1.

In accordance with another aspect of the present invention, there is provided a method of driving an organic light emitting diode (OLED) device, the method comprising: performing a gamma correction of inputted image data for the OLED device; changing a bit number of the gamma-corrected image data and thereby outputting converted image data; and generating and outputting a data drive signal on the basis of the converted image data.

In accordance with another aspect of the present invention, there is provided a method of operating a timing controller suitable for an organic light emitting diode device, the timing controller including a gamma correction unit and a control unit, the method comprising: receiving, by the gamma correction unit, an n-bit data and converting the n-bit data to an m-bit data by a gamma correction process, where m>n; and converting, by the control unit, the m-bit data to an n'-bit data by a dithering process, where n'=n or n'=n+1.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Hereinafter, an OLED device and a method for driving the same according to the preferred embodiments of the present invention will be described with reference to the accompanying drawings.

Figure 5:
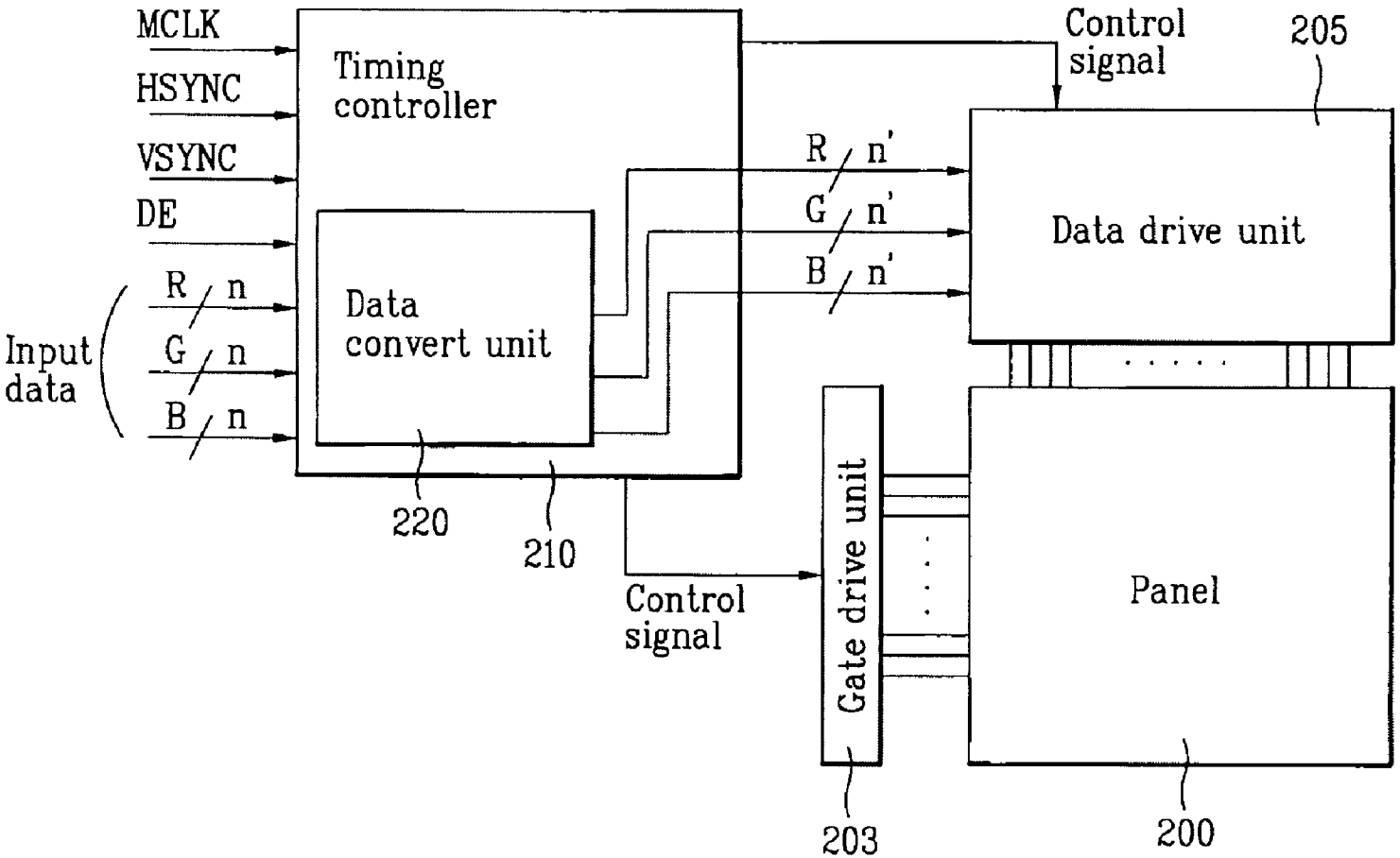
FIG. 5 is a block diagram illustrating an OLED device according to the present invention.
Figure 6:
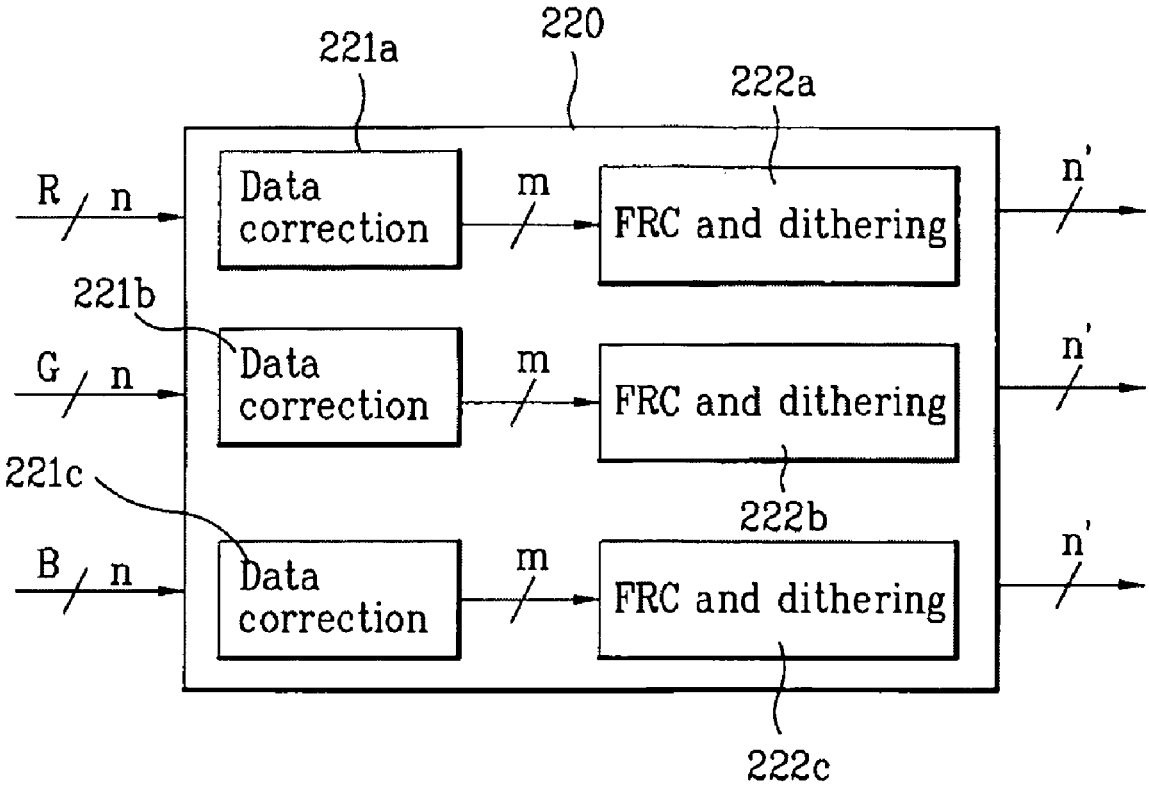
FIG. 6 is a block diagram illustrating a data convert unit of FIG. 5.

FIG. 5 is a block diagram illustrating an OLED (or OELD) device according to an embodiment of the present invention. FIG. 6 is a block diagram illustrating a data convert unit of FIG. 5 according to an embodiment of the present invention.

As shown in FIG. 5 and FIG. 6, the OLED device according to the present invention includes an OLED (or OELD) panel 200, a gate drive unit 203, a data drive unit 205, and a timing controller 210, all operatively coupled. At this time, the gate drive unit 203 and the data drive unit 205 respectively apply driving signals to gate and data lines formed on the OLED panel 200. Also, the timing controller 210 controls the gate drive unit 203 and the data drive unit 205.

The timing controller 210 receives RGB image data of n-bit, and synchronized signals HSYNC and VSYNC and clock signals DE and MCLK for displaying the corresponding RGB image data from a graphic source, e.g., from an external system. Then, the timing controller 210 performs gamma correction, color compensation, FRC (Frame Rate Control), and dithering, and outputs the compensated RGB data of n'-bit (n'=n or n'=n+1) to the data drive unit 205.

Particularly, the timing controller 210 includes a data convert unit 220. As shown in FIG. 6, the data convert unit 220 is provided with data correction units 221*a*, 221*b* and 221*c*, and FRC and dithering units 222*a*, 222*b* and 222*c*. At this time, the data correction units 221*a*, 221*b* and 221*c* convert the gamma characteristics of inputted RGB image data according to a gamma 2.2 curve, and thereby outputs the gamma-corrected RGB data of m-bit where m=n+2. Then, the FRC and dithering units 222*a*, 222*b* and 222*c* process the RGB data of m-bit by FRC and dithering and thereby outputs the RGB data of n'-bit, where n'=n or n'=n+1.

Figure 1:
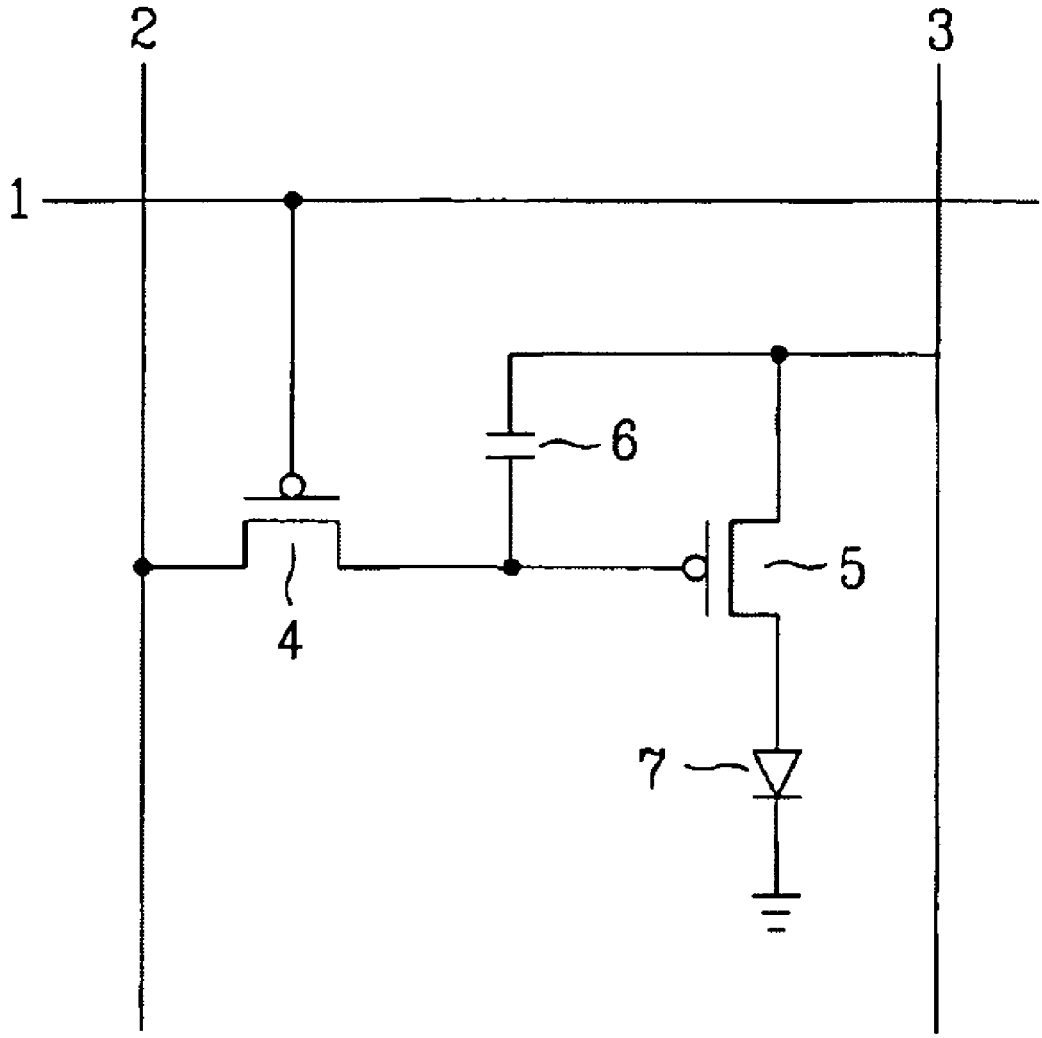
FIG. 1 Related Art
FIG. 1 is a circuit diagram illustrating an organic ELD device according to the related art.
Figure 2:
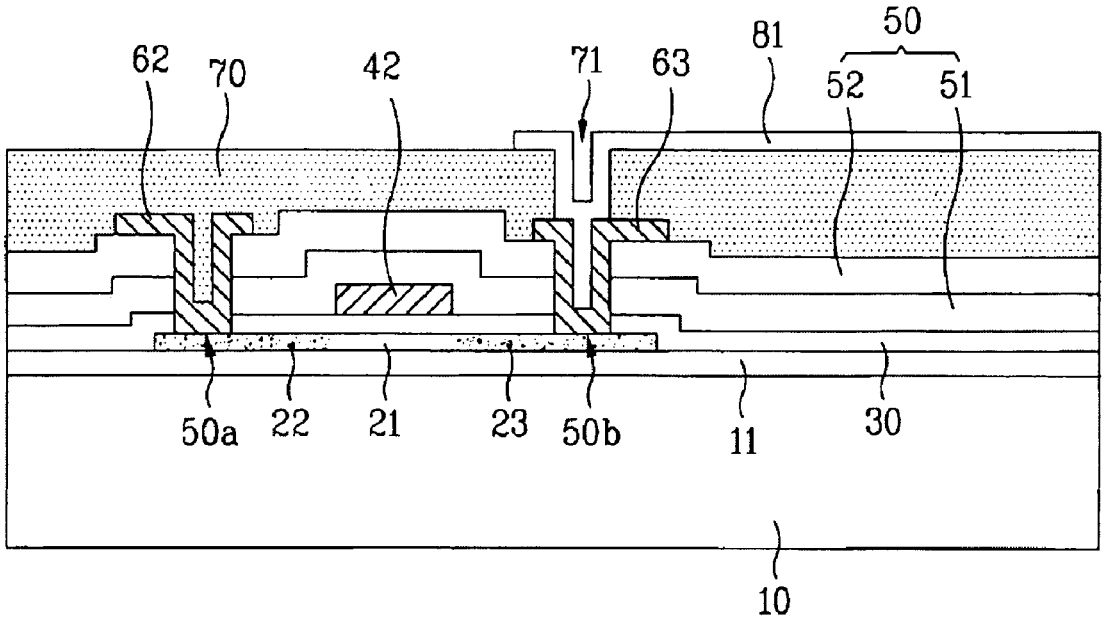
FIG. 2 Related Art
FIG. 2 is a cross sectional view illustrating a driving thin film transistor and an LED of FIG. 1.
Figure 3:
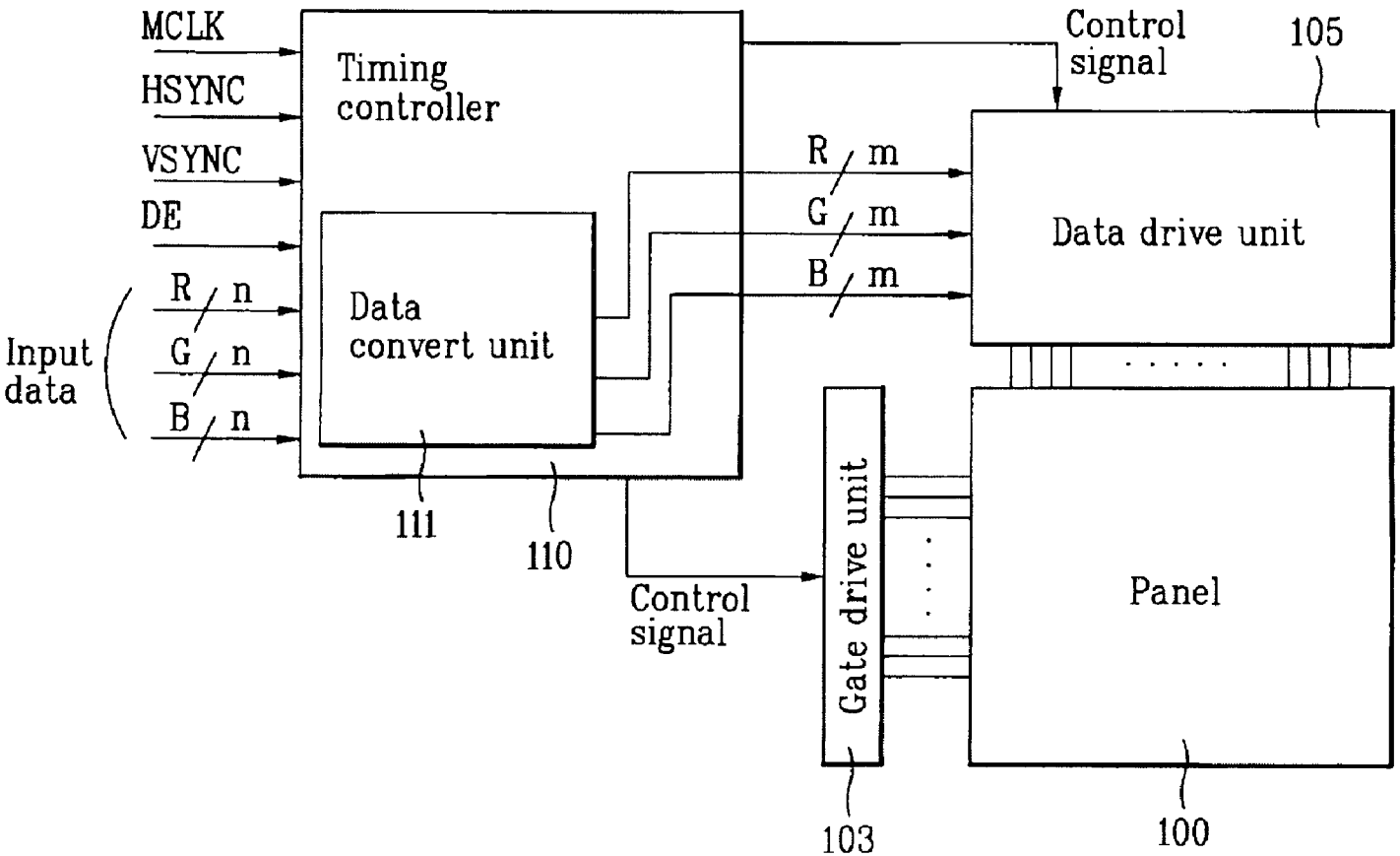
FIG. 3 Related Art
FIG. 3 is a block diagram illustrating a driving unit of an organic ELD device according to the related art.
Figure 4:
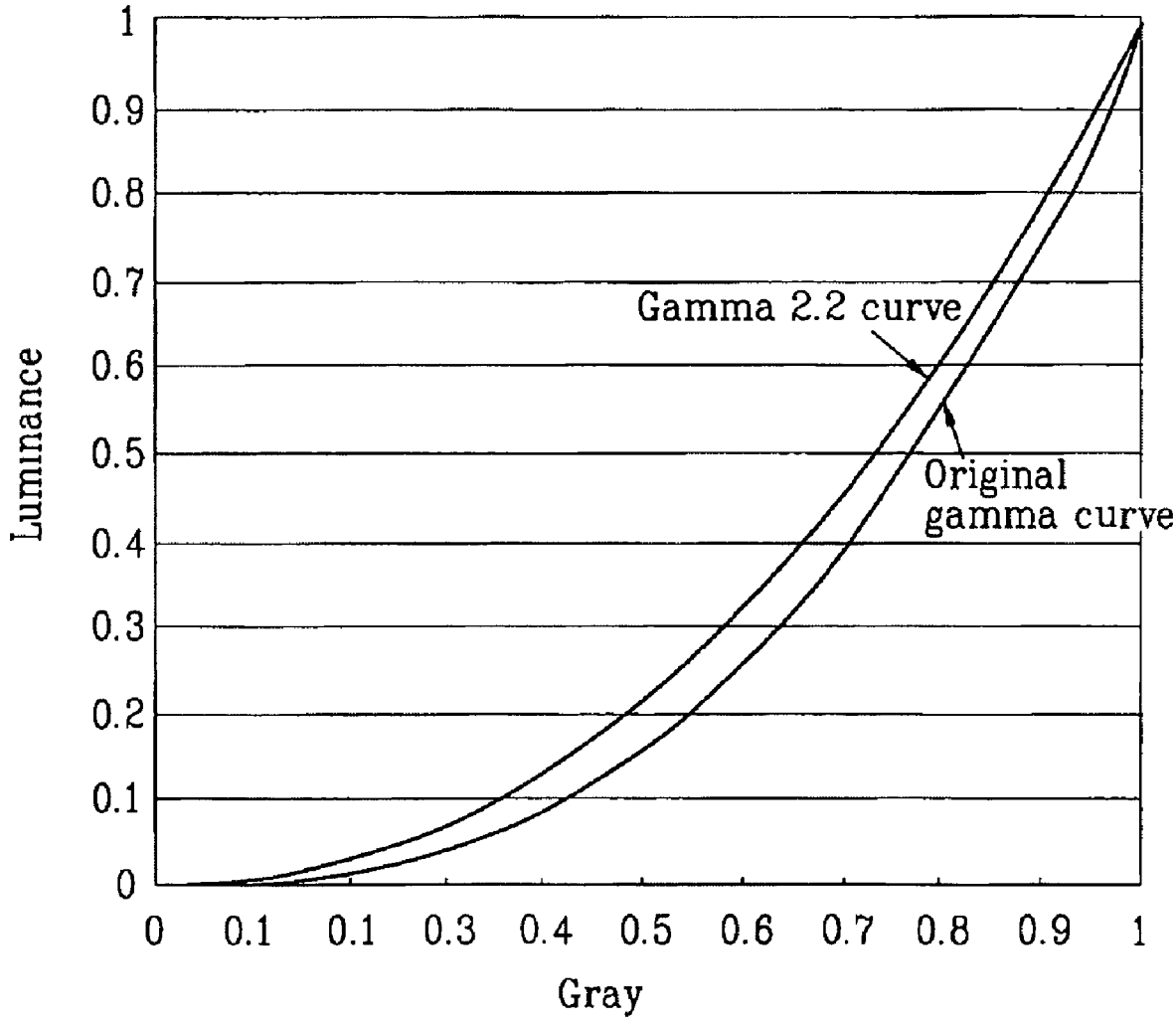
FIG. 4 Related Art
FIG. 4 is a graph illustrating the luminance characteristics by gray level before and after the gamma correction of FIG. 3.

The data correction units 221*a*, 221*b* and 221*c* alone function as a data convert unit provided in a timing controller of a related art OLED device (or OELD device) (e.g., as the data convert unit 111 of FIG. 3). That is, the data correction units 221*a*, 221*b* and 221*c* convert the gamma characteristics of the inputted original RGB image data of n-bit according to the gamma 2.2 curve, e.g., shown in FIG. 4, and outputs the RGB data of m-bit having the converted gamma characteristics in the same manner as the data convert unit 111. In other words, the data correction units 221*a*-221*c* perform the conversion of the gamma characteristics by LUT (Look-Up Table) or arithmetic of a numerical formula. For example, in case of using the LUT, when the RGB image data is inputted, RGB image data corresponding to the inputted RGB data is determined from the LUT and is outputted, wherein the LUT can be formed in a method of mapping the RGB image data having the converted gamma characteristics by each gray level of the original RGB image data. At this time, the bit number (m) in the RGB data of m-bit (m=n+2), having the converted gamma characteristics, is larger by two than the bit number (n) in the original RGB image data of n-bit, in order to improve accuracy in the conversion of the gamma characteristics.

According to the present invention, thereafter, the RGB image data of m-bit, converted by the data correction units 221*a*, 221*b* and 221*c*, is transmitted respectively to the FRC and dithering units 222*a*, 222*b* and 222*c*. Thus, the FRC and dithering units 222*a*, 222*b* and 222*c* perform a dithering process by time and space and a FRC (Frame Rate Control) process to the RGB image data of m-bit, whereby the m-bit of the RGB data is decreased to n'-bit, where n'=n or n'=n+1.

Accordingly, the FRC and dithering units 222*a*, 222*b* and 222*c* control the RGB image data of upper bit(s) in frequency and location by time and space, according to a predetermined lower bit(s) of the RGB image data outputted from the data correction units 221*a*, 221*b* and 221*c*. That is, the FRC and dithering units 222*a*, 222*b* and 222*c* decrease the bit number of the RGB image data. At this time, the bit number of the RGB image data outputted from the data correction units 221*a*-221*c* is decreased by either 1 bit or 2 bits by the FRC and dithering units 222*a*, 222*b* and 222*c*.

The dithering process by the FRC and dithering units 222*a*-222*c* involves processing the inputted gray data having a predetermined gray level represented by a certain number of bits to have a lower bit number than the original gray-level bit number. As a result, it is possible to display a desired color by the lower bit number instead of the gray-level bit number. In comparison with a case of displaying the color by the original gray-level bit number, the dithering process is advantageous in that power consumption is decreased.

In the dithering process by the FRC and dithering units 222*a*-222*c* for lowering the bit number of gray data, it is possible to select a reduction ratio of the lowered bit number to the original gray-level bit number. For example, according to the present invention, n' can be selected to equal n or (n+1). In this case, as the reduction ratio is smaller, the gray data is displayed more similar to the color of the original gray-level data, so that it is possible to decrease deterioration in picture quality. In the meantime, in a display device, as the bit number becomes lower, a circuit is operated less, thereby decreasing power consumption.

The FRC (Frame Rate Control) process by the FRC and dithering units 222*a*-222*c* is performed to prevent flicker, which is created when the same pixel is repetitively turned on and off. That is, in the FRC process, adjacent pixels in horizontal and vertical lines are differently turned on and off, so that it is possible to prevent the same pixel of sequential frames from being repetitively turned on and off.

Hereinafter, the FRC and dithering process according to the present invention will be described in detail.

Figure 7:
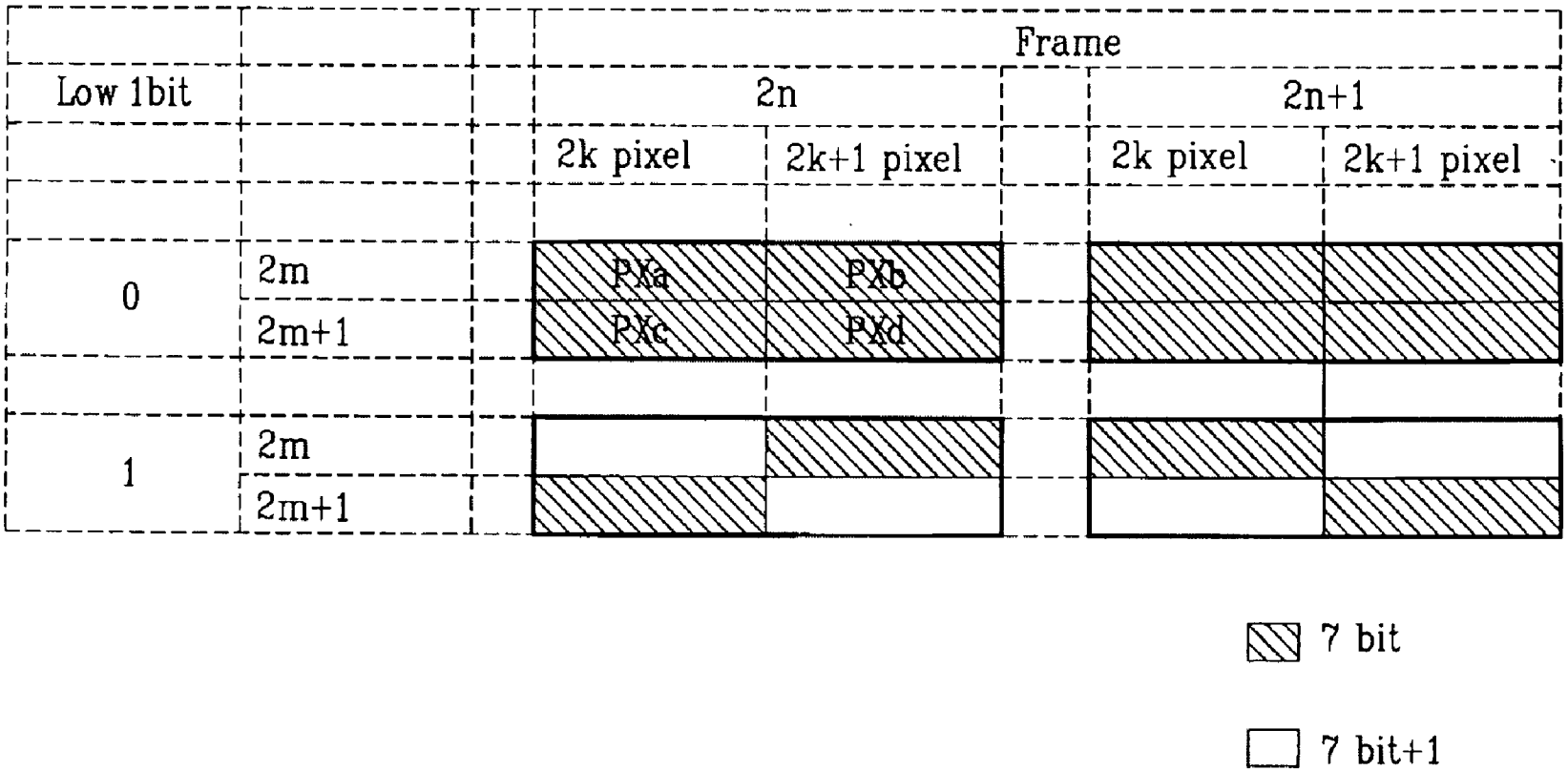
FIG. 7 is a view of pixel data arrangement for illustrating a driving method of an OLED device according to a first example of the present invention.
Figure 8:
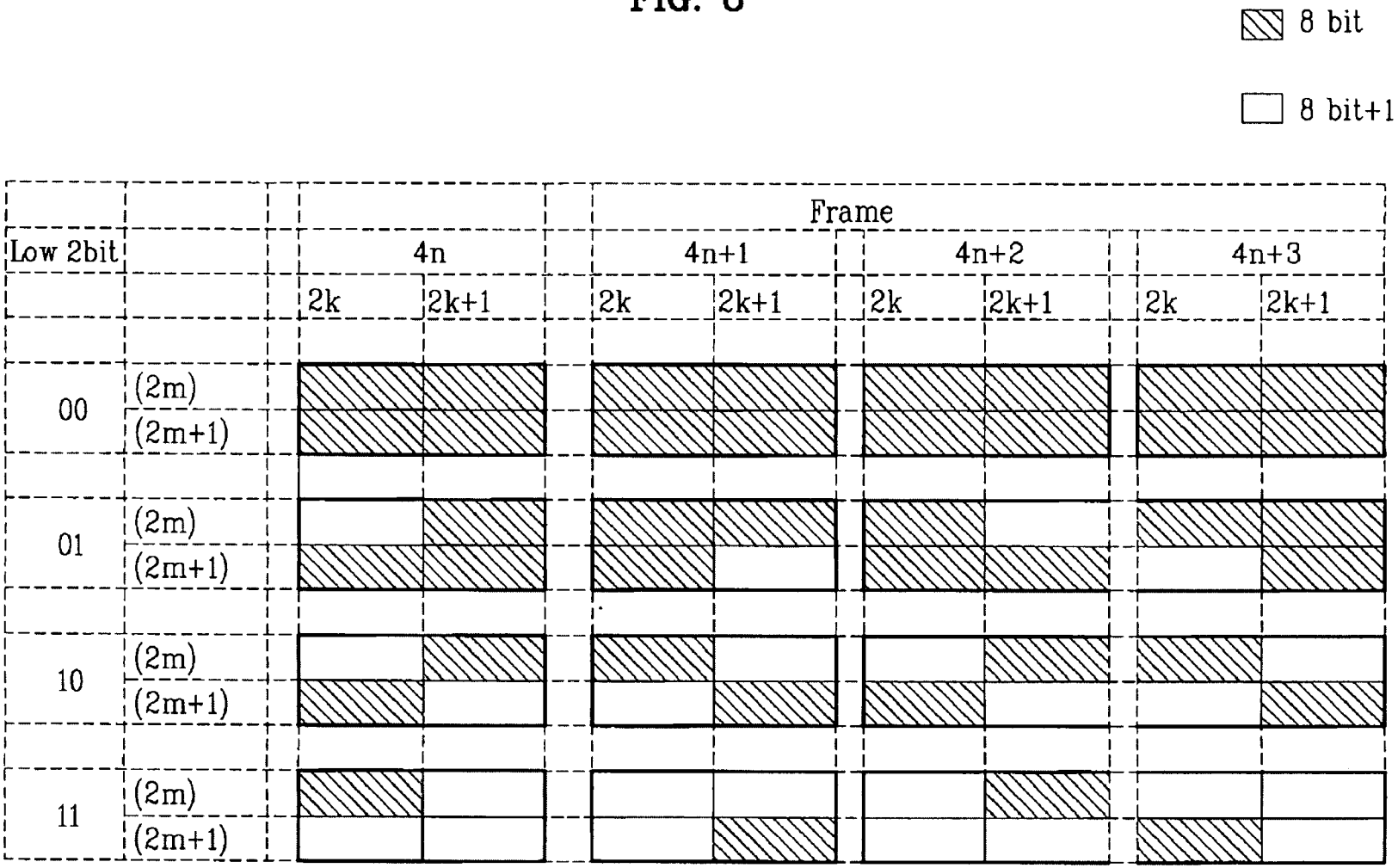
FIG. 8 is a view of pixel data arrangement for illustrating a driving method of an OLED device according to a second example of the present invention.

FIGS. 7 and 8 illustrate two examples of a bit-number reduction process for explaining a driving method of the OLED device according to the present invention. These examples are implemented in the OLED device of FIG. 5 or other suitable display devices. FIG. 7 illustrates an example of processing an n-bit data where n=6 and FIG. 8 illustrates an example of processing an n-bit data where n=8.

As shown in FIG. 7, in this first example, suppose that the original RGB image data has 6 bits (n=6) so that the bit number of the data corrected by and output from the data correction unit 221*a*, 221*b* or 221*c* of the timing controller 220 is 8 (m=8).

After that, the data of 8 bits is processed by the FRC and dithering units 222*a*-222*c*, whereby the 8-bit data may be converted to 6 bits. In this case, it may have flicker due to rapid response speed and great change in the luminance of the OLED device. To overcome these problems, in case the gamma corrected data has 8 bits, the lower 1 bit may be dropped such that the data becomes 7 bits.

Particularly, the data of 8 bits, outputted from the data correction units 221*a*, 221*b* and 221*c*, is divided into data of high 7 bits and data of low 1 bit. Here, the 'high 7 bits' is referring to 7 most significant bits within the 8-bit data, and the 'low 1 bit' is referring to one least significant bit (the last bit within the 8-bit data). Similar meaning is to be applied whenever the terms 'high x bit(s)' and 'low x bit(s)' are used where x is an integer>0. The value of the low 1 bit is either '0' or '1'. In FIG. 7, '2g' and '2g+1' correspond to horizontal-direction gate lines formed in parallel, which show the order of the gate lines. Also, '2k' and '2k+1' correspond to vertical-direction data lines formed in parallel, which show the order of the data lines. In 2n-th frame and 2n+1-th frame, four adjacent pixels PXa~PXd (defined by two adjacent gate lines and two adjacent lines) may be variously displayed according to whether the low 1 bit of the 8-bit data has a value of '0' or '1'.

In order to display a case where the data (value) of the low 1 bit of the 8-bit data is '0', four adjacent pixels display the data of the existing high 7 bits of the 8-bit data. This is indicated by the hatched lines (labeled '7 bit') in FIG. 7. That is, since the value of the low 1 bit (LSB) is '0', this bit is dropped without any loss of data and only the existing high 7 bits of data are displayed by the pixels. To display a case where the value of the low 1 bit is '1', the value of '1' is added to the data of the existing high 7 bits and then the added value in 7 bits is displayed in the two pixels among the four adjacent pixels (2×2 pixels of horizontal and vertical lines), whereby the data '1' of the low 1 bit is not lost even after the low 1 bit is dropped since it is applied to the other 7 bits in the two of the four adjacent pixels. This is indicated by a clear area (labeled '7' bit+1') in FIG. 7.

At this time, to prevent the flicker, as shown in FIG. 7, the location of the pixel corresponding to '7 bit+1' is moved along the frames. For instance, at frame no. 2n, the pixels PXa and PXd are assigned to '7 bit+1' data, whereas at frame no. 2n+1, '7 bit+1' data is assigned to the pixels PXb and PXc.

Accordingly, in the example of FIG. 7, the bit number of the data, reduced by the FRC and dithering process, is 1 bit, from 8 bits (m-bit) to 7 bits (n'-bit).

FIG. 8 displays a second example of the bit number reduction process by the FRC and dithering units according to the present invention. In this example, low 2 bits of m-bit data are dropped. As shown in FIG. 8, in the driving method of the OLED device, original RGB image data, inputted from the external graphic source to the timing controller 210, has 8 bits (n=8), and data outputted from the data correction units 221*a*-221*c* has 10 bits (m=10). From the 10-bit image data, 8-bit data is produced by a method of dropping low 2 bits of the 10-bit data, whereby the resultant 8-bit data is transmitted to the data drive unit 205 from the FRC and dithering units 222*a*-222*c*.

In this second example of the present invention, if a pixel is turned on and off by each 4 frame in the process of making the 8-bit data by the dithering process, it may have the flicker. Accordingly, in order to prevent the flicker, as shown in FIG. 8, the FRC process is also performed by the units 222*a*-222*c*, wherein the data is divided by each frame, so that it is possible to prevent the turning-on and off in the same position of the adjacent pixels during the sequential frames.

Referring to FIG. 8, data of 10 bits (m=10) from the data correction units 221*a*-221*c* is divided into data of high 8 bits (8 MSBs) and data of low 2 bits (2 LSBs), wherein the data of the low 2 bits will be '00', '01','10' or '11'. At this time, to display a case where the data of the low 2 bits is '00', the four adjacent pixels display the data of the existing high 8 bits of the 10-bit data while the low 2 bits of the 10-bit data are dropped. This is indicated by the hatched lines (labeled '8 bit'). In order to display a case where the data of the low 2 bits is '01', one pixel among the four adjacent pixels displays 8-bit data, which is obtained by adding a value of '1' to the existing high 8-bit data of the 10-bit data and displaying the added resultant data of 8-bits. This is indicated by the clear area (labeled '8 bit+1') shown for that pixel and is also referred to below as 'high 8-bit+1'. Accordingly, the dropped value '01' is applied to the existing high 8-bit data such that the four pixels have on the average the low 2 bit of '01'.

In the case where the value of the low 2 bits is '10', two pixels among the four adjacent pixels display the data of high 8-bit+1, while the other two pixels among the four adjacent pixels display the data of the existing high 8-bit.

In the case where the value of the low 2 bits is '11', three pixels among the four adjacent pixels are displayed with the data of high 8-bit+1, while the remaining one pixel displays the data of the existing high 8-bit.

In all these cases, in order to prevent the flicker, the position of the pixel corresponding to high 8-bit+1 is moved along the frames in the same manner as in FIG. 7. FIG. 8 shows the method of changing the position of the values for the pixels by the frames of '4n', '4n+1', '4n+2' and '4n+3'.

In the OLED device and the method for driving the same according to the present invention, inputted original RGB data having a predetermined bit number (n) is converted to data having a bit number (m) larger by two than the predetermined bit number (n) of the original RGB by the gamma correction process. Then the converted data having the larger bit number (m) is converted again in the FRC and dithering process, whereby the bit number of the data inputted to the data drive IC is the same as that of the inputted original RGB data, or has a bit number corresponding to the value of adding '1' to the bit number of the inputted gamma-corrected data, thereby decreasing the area of the data drive unit (drive IC) and the power consumption.

As mentioned above, the OLED device and the method for driving the same according to the present invention have the following advantages.

In the OLED device and the method for driving the same according to the present invention, the FRC and dithering process is performed for the gamma correction, whereby the data processing capacity and the area of the drive IC decrease, thereby decreasing the power consumption.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An organic light emitting diode (OLED) device comprising:

a timing controller for performing a gamma correction of inputted image data for the OLED device, and then changing a bit number of the gamma-corrected image data to thereby output converted image data, wherein the inputted image data has 6 bits, the gamma-corrected image data has 8 bits; and a data drive unit for outputting a data drive signal on the basis of the converted image data;

wherein the timing controller converts gamma characteristic of the inputted image data according to a gamma 2.2 curve when performing the gamma correction of the inputted image data;

wherein the timing controller converts gamma characteristic of the inputted image data by determining RGB image data corresponding to the inputted image data from a look-up table;

wherein the look-up table is formed in a method of mapping the RGB image data having the converted gamma characteristics by each gray level of the image data;

wherein the timing controller includes:

a data correction unit for correcting the inputted image data to have predetermined gamma characteristics; and a data control unit for controlling high bit data of the gamma-corrected image data in frequency and location by time and space, according to the remaining low bit data of the gamma-corrected image data;

wherein the data of 8 bits of the gamma-corrected image data outputted from the data correction unit is divided into data of high 7 bits and data of low 1 bit;

wherein the high 7 bits is referring to 7 most significant bits within the 8 bit data, and the low 1 bit is referring to one least significant bit;

wherein four adjacent pixels display the data of the existing high 7 bits of the 8 bit data when the data of the low 1 bit of the 8 bit data is '0';

wherein two pixels among the four adjacent pixels display the data of the existing high 7 bits of the 8 bit data while another two pixels among the four adjacent pixels display high 7-bit+1 which is obtained by adding the value of '1' to the existing high 7 bit data of the 8 bit data when the data of the low 1 bit of the 8 bit data is '1'.

2. The OLED device of claim 1, further comprising:

a gate drive unit for outputting a gate drive signal according to a control signal provided from the timing controller; and an OLED panel being driven by the data drive unit and the gate drive unit.

3. The OLED device of claim 1, wherein the data control unit is formed of a frame rate control (FRC) and dithering unit.

4. A timing controller suitable for an organic light emitting diode (OLED) device, the timing controller comprising:

a gamma correction unit to receive an n-bit data and convert the n-bit data to an m-bit data by a gamma correction process; and a control unit to convert the m-bit data to an n'-bit data by a dithering process;

wherein the n-bit data has 8 bits and the m-bit data has 10 bits;

wherein the gamma correction unit converts gamma characteristic of the n-bit data according to a gamma 2.2 curve when converting the n-bit data to the m-bit data by the gamma correction process;

wherein the timing controller converts gamma characteristic of the inputted image data by determining RGB image data corresponding to the inputted image data from a look-up table;

wherein the look-up table is formed in a method of mapping the RGB image data having the converted gamma characteristics by each gray level of the image data;

wherein the timing controller includes:

a data correction unit for correcting the inputted image data to have predetermined gamma characteristics; and a data control unit for controlling high bit data of the gamma-corrected image data in frequency and location by time and space, according to the remaining low bit data of the gamma-corrected image data;

wherein data of 10 bits from the data correction unit is divided into data of high 8 bits and data of low 2 bits;

wherein four adjacent pixels display the data of the existing high 8 bits of the 10-bit data while the low 2 bits of the 10-bit data are dropped when the data of the low 2 bits is '00';

wherein one pixel among the four adjacent pixels displays 8 bit+1 data, which is obtained by adding a value of '1' to the existing high 8-bit data of the 10-bit data and displaying the added resultant data of 8 bits when the data of the low 2 bits is '01';

wherein two pixels among the four adjacent pixels display the data of high 8 bit+1 while the other two pixels among the four adjacent pixels display the data of the existing high 8 bits when the data of the low 2 bits is '10';

wherein three pixels among the four adjacent pixels display the data of high 8 bit+1 while the remaining one pixel displays the data of the existing high 8 bits when the data of the low 2 bits is '11'.

* * * * *